US008350648B2

(12) United States Patent
Cueto

(10) Patent No.: US 8,350,648 B2
(45) Date of Patent: Jan. 8, 2013

(54) POWER CONTROL DEVICE AND ASSEMBLY

(76) Inventor: Gus Cueto, Atlanta, GA (US)

( * ) Notice: Subject to any disclaimer, the term of this patent is extended or adjusted under 35 U.S.C. 154(b) by 305 days.

(21) Appl. No.: 12/823,239

(22) Filed: Jun. 25, 2010

(65) Prior Publication Data

US 2010/0265017 A1 Oct. 21, 2010

Related U.S. Application Data

(63) Continuation-in-part of application No. 12/512,663, filed on Jul. 30, 2009, now abandoned.

(60) Provisional application No. 61/086,049, filed on Aug. 4, 2008.

(51) Int. Cl.
*H01H 9/02* (2006.01)
*H01H 13/04* (2006.01)

(52) U.S. Cl. ..... 335/202; 335/26; 335/107; 335/116; 335/165; 335/166; 335/170; 335/185; 335/186; 335/86; 335/177; 335/191; 200/339; 200/401

(58) Field of Classification Search ..... 335/12, 335/26, 89, 107, 116, 150, 161, 164, 165, 335/166, 169–170, 173, 185, 186, 78–86, 335/128, 177–179, 191, 202; 200/339, 401
See application file for complete search history.

(56) References Cited

U.S. PATENT DOCUMENTS 3,506,188 A 4/1907 Behrens et al.
2,119,450 A 5/1938 Trautner
3,052,778 A * 9/1962 Kathe ..... 335/207
3,104,384 A 9/1963 Slate
3,225,156 A * 12/1965 Sahrbacker ..... 200/5 B
3,254,191 A * 5/1966 Reiner ..... 200/339
3,582,845 A 6/1971 Brockway
3,700,972 A 10/1972 Bates
3,842,375 A 10/1974 Collette
3,893,054 A 7/1975 Marcoux et al.
4,095,213 A 6/1978 Hayden
4,220,937 A 9/1980 Ritzenthaler
4,264,886 A 4/1981 Nettro
4,370,565 A 1/1983 Hayden
(Continued)

OTHER PUBLICATIONS

"GE Total Lighting Control-Remote Control Low Voltage Switching," www.ge.com/tlc, Sep. 1998, 32 pages, General Electric Company, USA.

(Continued)

*Primary Examiner* — Mohamad Musleh
(74) *Attorney, Agent, or Firm* — Morris, Manning & Martin, LLP; John R. Harris

(57) ABSTRACT

A power control apparatus in the form of a standard, toggle, wall-mounted light switch for remote actuation of an electrical load or local manual override. A switch housing supports and retains a latching relay that includes power terminals, a switching terminal for remote actuation by a control signal, and a manual override. A switch lever extends from the body of the switch housing for manual actuation to override the state of the relay. The switch lever engages the manual override of the latching relay upon manual actuation by a person. A centering structure maintains the switch lever in a centered position to allow unimpeded movement of the manual override. The latching relay can be remotely actuated by a signal at its switching terminal to switch a power load connected to the power terminals on or off, or the relay can be manually overridden by actuation of the switch lever.

25 Claims, 12 Drawing Sheets

U.S. PATENT DOCUMENTS

| | | | | | |
|---|---|---|---|---|---|
| 4,370,638 | A | * | 1/1983 | Takeda et al. | 335/186 |
| 4,376,895 | A | | 3/1983 | Meister | |
| 4,376,896 | A | | 3/1983 | Takeda et al. | |
| 4,393,360 | A | | 7/1983 | Arakawa et al. | |
| 4,668,926 | A | * | 5/1987 | Comtois et al. | 335/21 |
| 4,713,636 | A | | 12/1987 | Lemmer et al. | |
| 4,716,392 | A | * | 12/1987 | Nakano et al. | 335/189 |
| 4,767,895 | A | * | 8/1988 | Parrish | 200/43.04 |
| 4,800,352 | A | | 1/1989 | Haury et al. | |
| 4,816,792 | A | | 3/1989 | Belbel et al. | |
| 4,975,665 | A | | 12/1990 | Ohishi et al. | |
| 5,049,846 | A | * | 9/1991 | Morgan et al. | 335/202 |
| 5,072,328 | A | | 12/1991 | Dvorak et al. | |
| 5,119,053 | A | | 6/1992 | Mostosi | |
| 5,163,175 | A | | 11/1992 | Mori et al. | |
| 5,252,933 | A | | 10/1993 | Kamino et al. | |
| 5,525,948 | A | | 6/1996 | Poulsen | |
| 5,872,499 | A | | 2/1999 | Poulsen | |
| 5,883,557 | A | | 3/1999 | Pawlak et al. | |
| 5,912,534 | A | | 6/1999 | Benedict | |
| 6,023,212 | A | | 2/2000 | Mader | |
| 6,121,863 | A | | 9/2000 | Hwang | |
| 6,714,106 | B1 | | 3/2004 | Czarnecki et al. | |
| 6,819,014 | B2 | | 11/2004 | Lo et al. | |
| 6,975,191 | B2 | | 12/2005 | Ward | |
| 7,623,010 | B2 | | 11/2009 | Liu | |
| 2006/0145794 | A1 | | 7/2006 | Batteux | |

OTHER PUBLICATIONS

"Wired Maestro Local Controls," http://resi.lutron.com; undated, pp. 58-65.

* cited by examiner

TOP

SIDE

BACK

FRONT

POWER CONTROL DEVICE AND ASSEMBLY

CROSS REFERENCE TO RELATED APPLICATIONS

This application is a continuation-in-part of and claims benefit of and priority to U.S. patent application Ser. No. 12/512,663, filed Jul. 30, 2009, entitled "Power Control Device and Methods," which in turn claims benefit of and priority to U.S. Provisional Patent Application No. 61/086,049, filed Aug. 4, 2008, which applications are fully incorporated herein by reference in their entirety and made a part hereof.

FIELD

Embodiments described herein relate to power control devices and, in particular to a lighting control switch and assembly therefor.

BACKGROUND

Currently in the lighting control market, there are no inexpensive, reliable lighting control options, a challenge that is most notably prevalent for a non-industrial application. While the marketplace offers systems with sophisticated microprocessor controlled devices that communicate over a hardwired or RF communication bus using proprietary protocols, what is needed is a reliable, inexpensive and adaptable power control device that overcomes many of the challenges found in the art, some of which are described above.

SUMMARY

Described herein are methods, systems, and apparatuses for power control. In one aspect, provided are power control apparatuses, comprising: a plurality of coils; at least one relay contact, associated with said plurality of coils. The relay contact, associated with a first coil, is closed upon the first coil receiving a first remote signal. The relay contact, also associated with a second coil, is opened upon the second coil receiving a second remote signal. The apparatus further comprises a local manual control that is mechanically coupled to the relay contact. The local manual control is configured to mechanically close the relay contact and to mechanically open the relay contact. The relay contact is configured for continuously energizing a load, upon closing the at least one relay contact, either by the first coil receiving the first remote signal or mechanically by the local manual control, and for de-energizing the load, upon opening the at least one relay contact, either by the second coil receiving the second remote signal or mechanically by the local manual control.

In another aspect, the power control apparatus is embodied in the form of a standard, toggle, wall-mounted light switch.

In yet another aspect, methods for power control are described herein. The methods can comprise providing a power control apparatus. The power control apparatus is comprised of a relay contact, a first coil and a second coil associated with the relay contact, and a local manual control. The relay contact of the power control apparatus is configured to close upon the first coil associated with the relay contact receiving a first remote signal. The relay contact of the power control apparatus is configured to open upon the second coil associated with the relay contact receiving a second remote signal. The local manual control is mechanically coupled to the relay contact, wherein the local manual control is configured to be operated manually, in order to mechanically close the relay contact and to mechanically open the relay contact. The power control apparatus is configured for continuously energizing a load, upon closing the relay contact, either by the first coil receiving the first remote signal or mechanically, by operating the local manual control, and for de-energizing the load, upon opening the relay contact, either by the second coil receiving the second remote signal or mechanically, by operating the local manual control.

In another aspect, provided are methods, systems, and apparatuses for remote power control as described above, wherein the local manual control is a manual switch, wherein the manual switch is mechanically coupled to the at least one relay contact, such that applying pressure to the manual switch in a first direction mechanically closes the at least one relay contact, thereby energizing the load, and such that applying pressure to the manual switch in a second direction mechanically opens the at least one relay contact, thereby de-energizing the load. In one aspect, the switch is spring-loaded, such that it returns to an inactive position once pressure is released. In another aspect, the power control apparatus is embodied in the form of a standard, toggle, wall-mounted light switch.

Additional advantages will be set forth in part in the description that follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

BRIEF DESCRIPTION OF THE DRAWINGS

The accompanying drawings, which are incorporated in and constitute a part of this specification, illustrate embodiments and together with the description, serve to explain the principles of the methods and systems.

DETAILED DESCRIPTION

Figure 1:
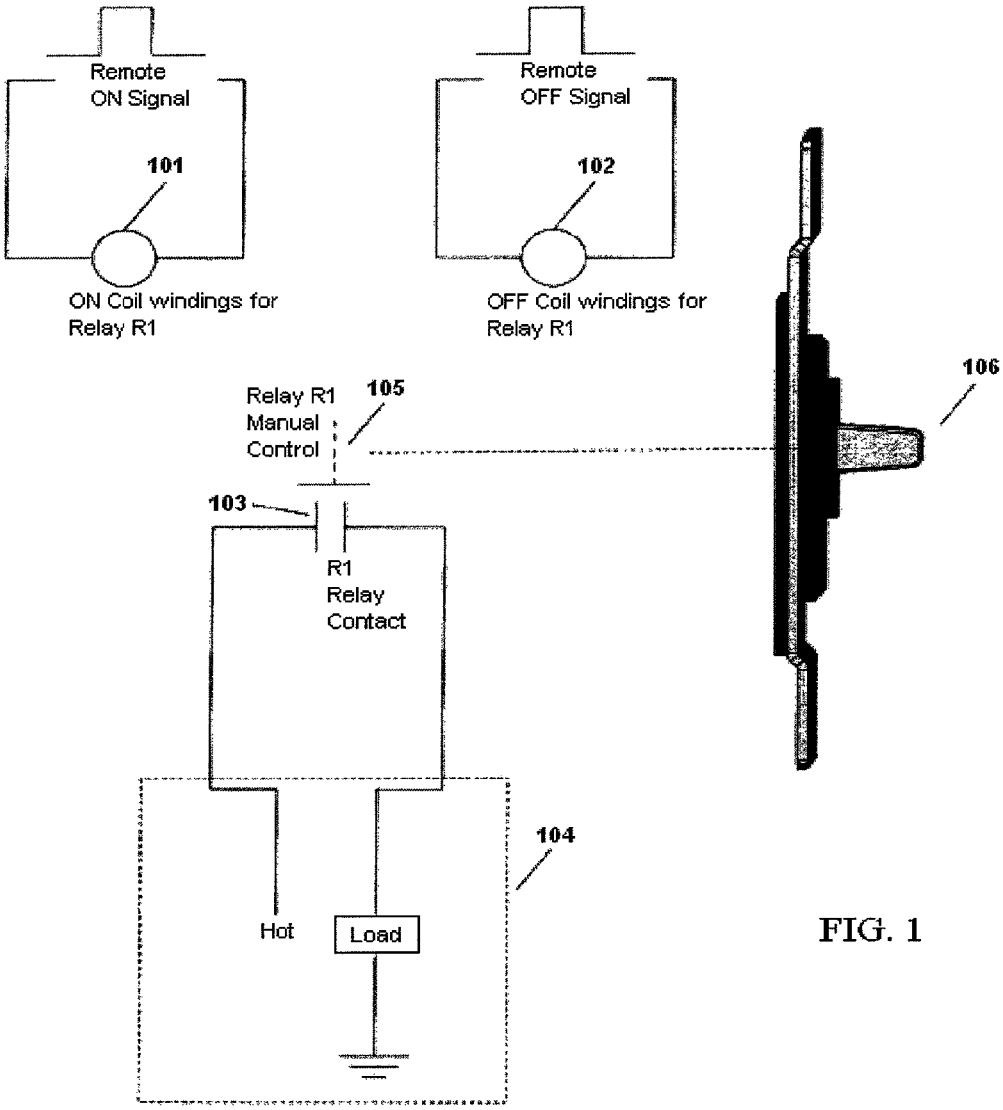
FIG. 1 is an exemplary apparatus for power control.

Before the present methods and systems are disclosed and described, it is to be understood that the apparatuses, methods and systems are not limited to specific synthetic methods, specific components, or to particular compositions, as such may, of course, vary. It is also to be understood that the terminology used herein is for the purpose of describing particular embodiments only and is not intended to be limiting.

As used in the specification and the appended claims, the singular forms "a," "an" and "the" include plural referents, unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. Further, the phrase "such as" as used herein is not intended to be restrictive in any sense, but is merely explanatory and is used to indicate that the recited items are just examples of what is covered by that provision.

Disclosed are components that can be used to perform the disclosed methods, apparatuses and systems. These and other components are disclosed herein, and it is understood that when combinations, subsets, interactions, groups, etc. of these components are disclosed that, while specific reference of each various individual and collective combinations and permutation of these may not be explicitly disclosed, each is specifically contemplated and described herein, for all methods, apparatuses and systems. This applies to all aspects of this application including, but not limited to, steps in disclosed methods. Thus, if there are a variety of additional steps that can be performed, it is understood that each of these additional steps can be performed with any specific embodiment or combination of embodiments of the disclosed methods.

The present methods, systems, and apparatuses may be understood more readily by reference to the following detailed description of preferred embodiments and the Examples included therein and to the Figures and their previous and following description.

The method, systems, and apparatuses disclosed herein comprise relays. Since relays are switches, the terminology applied to switches can also be applied to relays. A relay can switch one or more poles, each of whose contacts can be thrown by energizing the coil in one of three ways: Normally-open (NO) contacts connect the circuit when the relay is activated, the circuit is disconnected when the relay is inactive (also referred to as a Form A contact or "make" contact); Normally-closed (NC) contacts disconnect the circuit when the relay is activated, the circuit is connected when the relay is inactive (also referred to as a Form B contact or "break" contact); Change-over, or double-throw, contacts control two circuits, one normally-open contact and one normally-closed contact with a common terminal (also referred to as a Form C contact or "transfer" contact. If this type of contact utilizes a "make before break" functionality, then it is called a Form D contact).

A Single Pole Double Throw (SPDT) is a terminal that can connect to either of two others terminals. Including two for the coil, such a relay can have five terminals in total. A Double Pole Double Throw (DPDT) is a terminal comprising two rows of change-over terminals. Equivalent to two SPDT switches or relays actuated by a single coil. Such a relay can have eight terminals, including the coil.

Examples of relays include, but are not limited to, latching relays, reed relays, mercury-wetted reed relays, polarized relays, machine tool relays, contactor relays, solid state contactor relays, Buchholz relays, forced-guided contacts relays, solid state relays, and overload protection relays. By way of example and not meant to be limiting, the present methods, systems, and apparatuses are described herein using latching relays. However, it is specifically contemplated that other types of relays can be used without departing from the scope of the methods, systems, and apparatuses described herein. A latching relay can have two relaxed states (bistable). These can be referred to as "keep" relays. When the current is switched off, the relay remains in its last state. This can be achieved with a solenoid operating a ratchet and cam mechanism, or by having two opposing coils with an over-center spring or permanent magnet to hold the armature and contacts in position while the coil is relaxed, or with a remnant core. In the two coil example, a pulse to one coil turns the relay on and a pulse to the opposite coil turns the relay off. This type of relay can consume power only for an instant, while it is being switched, and retain its last setting across a power outage.

In one aspect, provided is a relay-controlled light switch, comprising a plurality of power inputs, configured for turning a power load ON and OFF, and a dry contact feedback, to indicate if the load is ON.

In an aspect, provided are apparatuses for use in a "two-wire" installation. The "two-wire" apparatus is configured to use a hot (energized) and return switch legs, available at the switch. This type of wiring is typically found in commercial installations. A "three-wire" apparatus can be configured to use a hot, neutral (not switched) and return switch legs, available at the switch.

In an aspect, provided is a two-wire power switch with low voltage remote actuation control using one or more latching relays such as for example a 24 VDC latching relay as are known in the art, though latching relays of various voltage and current ratings are contemplated within the scope of embodiments of the invention. The power switch can be remotely controlled by voltage pulses such as for example 12 VDC, 24 VDC, 48 VDC, etc., and locally controlled by a manual switch. The power switch can be used to remotely control lights, motors and any other electrically powered system. The power switch can interface with any automation system. The power switch can comprise a mechanically latching power relay with one or more coils such as, for example, two coils. In one instance for a relay having two coils, a low voltage pulse to either of the relay coils that has not been activated can cause a change of state to the mechanically latching power relay, causing power to be applied, or discontinued, to the attached electrical device. In another instance, a relay can be associated with only one coil. Applying a voltage pulse to the coil can change the state of the relay (i.e., if the relay is closed, applying the voltage pulse will cause it to open and stay open; alternatively, if the relay is open, applying the voltage pulse will cause the relay to close and stay closed). The manual switch can also be used to control power to the load. Applying pressure to the manual switch in a first direction such as, for example an upward direction, can cause the circuit to change to the ON state and applying pressure to the manual switch in a second direction such as, for example, a downward direction, can cause the circuit to change to the OFF state. The power switch can comprise an interlocking circuit that can prevent simultaneous ON-OFF signals from damaging the relay, thus increasing switch life and reliability.

In an aspect, provided is an electrical power control device, comprising means to be remotely controlled by low voltage pulses. The device can comprise means to be actuated to a known state of open or closed circuit by a remote low voltage pulse. The device can comprise an interlocking circuit such that, if the relay has more than one coil and a simultaneous pulse to both the open and close circuit is received, one pulse can be ignored preventing the control circuit from being damaged. The device can also comprise a local, mechanically interlocked switch that can allow local control of the circuit. This switch can be mechanically interlocked, such that the ON and OFF positions cannot be achieved simultaneously. Said device can be used to control lights, motors or any other electrically powered device, or combination of devices.

In one aspect, illustrated in FIG. 1 is a two-wire embodiment of a power control apparatus 100. To remotely turn ON said apparatus, a first voltage pulse such as, for example, a 12 VDC pulse, a 24 VDC pulse, a 48 VDC pulse, etc., can be applied to the ON Coil windings 101 for Relay R1 102. The voltage and current rating of the ON coil windings 101 can be selected depending upon the source of the first voltage pulse. Energization of the ON coil winding 101 by the first voltage pulse can close Relay R1's contact 103, thus completing the circuit and energizing the load within the dashed box 104. The load within the dashed box 104 can be any type of load, such as a light, a motor or any other device, or combination of devices, that is within the voltage and current specifications of the apparatus. Because Relay R1 is a mechanically latching relay, it can remain in this position when the pulse is removed from the ON Coil windings for Relay R1 101, thereby not requiring constant energization and power loss.

To remotely turn OFF said apparatus 100, a second voltage pulse such as, for example, a 12 VDC pulse, a 24 VDC pulse, a 48 VDC pulse, etc., can be applied to the OFF Coil windings for Relay R1 102. This can open Relay R1's contact 103, thus de-energizing the load within the dashed box 104. The load within the dashed box 104 can be any type load, such as a light, a motor or any other device, or combination of devices, that is within the voltage and current specifications of the apparatus. Because Relay R1 is a mechanically latching relay, it can remain in this position when the pulse is removed from the OFF Coil windings for Relay R1 102 thereby not requiring constant energization and power loss.

Because of the use of a mechanical latching relay, coils associated with the relay R1 do not require constant energization. Thus, the device 100 does not consume energy while in the ON state or the OFF state.

To locally turn ON said apparatus, pressure can be applied in a first direction such as, for example, an upward direction, to a manual switch 106, mechanically coupled to Relay R1's contact 103 via the manual control 105, thereby causing Relay R1's contact 103 to close, thus energizing the load within the dashed box 104. The load within the dashed box (104) can be any type load, such as a light, a motor or any other device, or combination of devices, that is within the voltage and current specifications of the apparatus. Though not confined to this form, in one aspect the power control apparatus 100 can be embodied in the form of a standard, toggle, wall-mounted light switch.

To locally turn OFF said apparatus 100, pressure can be applied in a second direction such as, for example, a downward direction, to the manual switch 106, thereby causing Relay R1's contact 103 to open, thus de-energizing the load within the dashed box 104. The load within the dashed box 104 can be any type load, such as a light, a motor or any other device, or combination of devices, that is within the voltage and current specifications of the apparatus.

Control signals can be sent to the apparatus from many devices. Examples include, but are not limited to, a building security system, a simple push button, a Building Automation System (BAS) or an occupancy sensor. A security system can send a pulse to turn OFF all the lights when the building is vacated or turn ON all the lights when a burglary is detected or the building becomes occupied. A simple push button can be used to allow convenient control of lights from one or more locations without expensive electrical rewiring. Occupancy sensors can be used to send control signals to the apparatus to shut down lights when a building space is unoccupied. More sophisticated BAS systems can also interface with the apparatus allowing advanced energy management by controlling lights.

Figure 2:
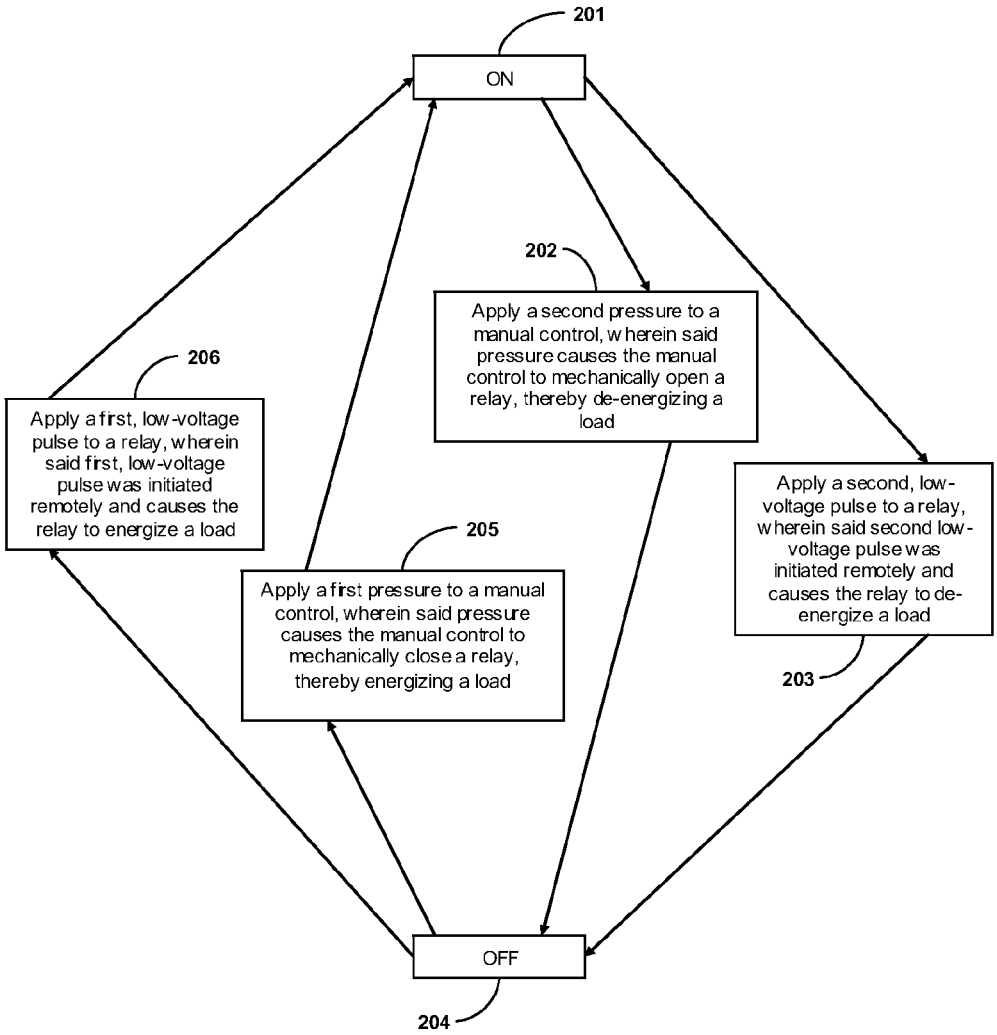
FIG. 2 is an exemplary method of operation an apparatus for power control.

In another aspect, illustrated in FIG. 2, provided are methods for power control, comprising applying a first, low-voltage pulse such as, for example, a 12 VDC pulse, a 24 VDC pulse, a 48 VDC pulse, etc., to a first coil associated with a relay contact, wherein the first, low-voltage pulse can be initiated remotely. The first pulse, applied to the first coil, causes the relay contact to change from an OPEN state to a CLOSED state, thereby causing the relay to energize a load at 206. A second, low-voltage pulse such as, for example, a 12 VDC pulse, a 24 VDC pulse, a 48 VDC pulse, etc., applied to a second coil associated with the relay contact, causes the relay contact to change from a CLOSED state to an OPEN state. The second, low-voltage pulse can be initiated remotely and causes the relay to OPEN, thus de-energizing a load at 203. The relay contact can also be controlled locally by a mechanically-operated switch. For example, applying a first pressure to a manual control, wherein the pressure causes the manual control to mechanically close a relay (assuming it was open to begin with), thereby energizing a load at 205. Applying a second pressure to the manual control causes the manual control to mechanically open a relay (assuming it was closed), thereby de-energizing a load at 202.

Figure 3:
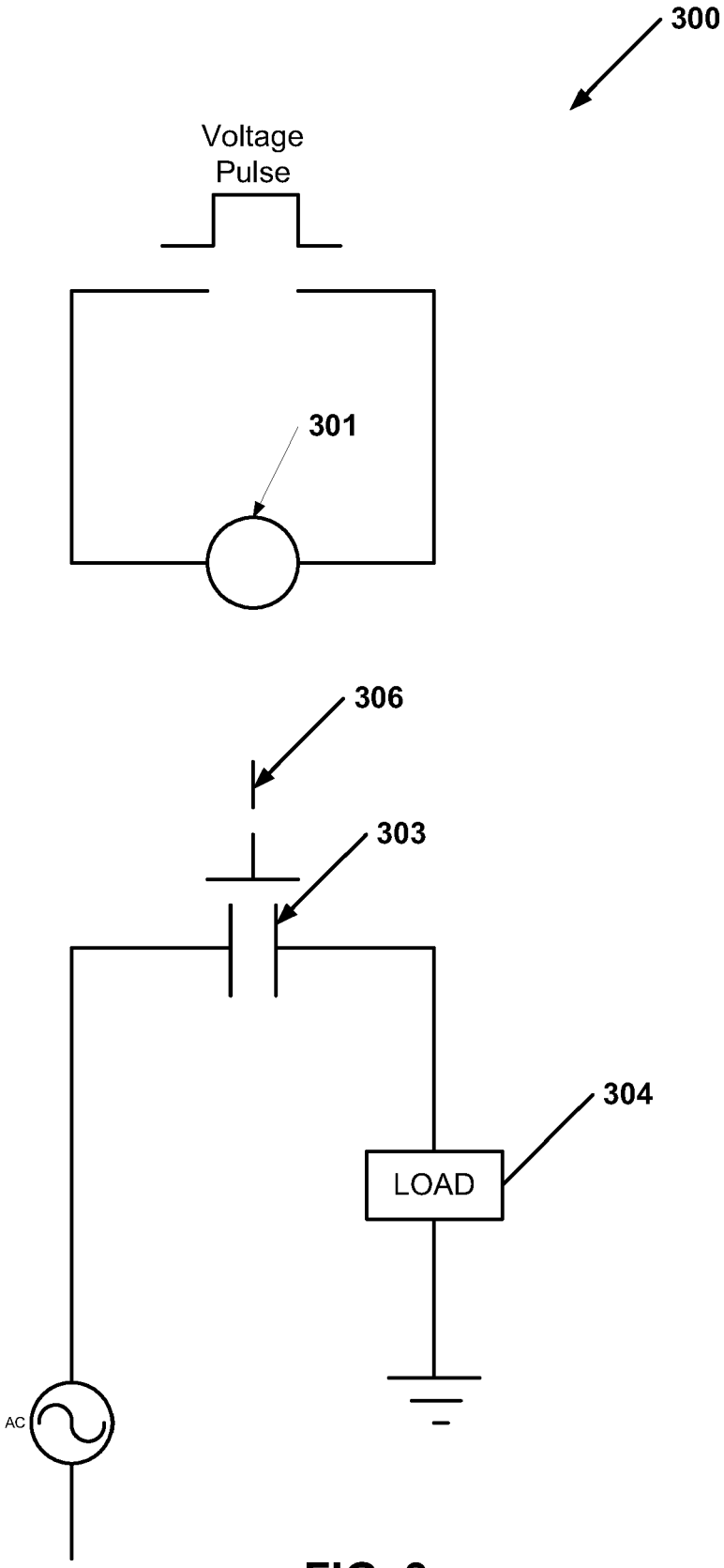
FIG. 3 is another two-wire embodiment of a power control apparatus comprising a relay contact associated with a single coil.

Illustrated in FIG. 3 is another two-wire embodiment of a power control apparatus 300 comprising a relay contact 303 associated with a single coil 301. To remotely turn ON said apparatus, where ON means to close the contact 303, a first voltage pulse such as, for example, a 12 VDC pulse, a 24 VDC pulse, a 48 VDC pulse, etc., can be applied to the coil windings 301 for Relay R1. The voltage and current rating of the coil windings 301 can be selected depending upon the source of the first voltage pulse. Energization of the coil winding 301 by the first voltage pulse can close Relay R1's contact 303, thus completing the circuit and energizing the load 304. The load 304 can be any type of load, such as a light, a motor or any other device, or combination of devices, that is within the voltage and current specifications of the apparatus. Because Relay R1 is a mechanically latching relay, it can remain in this position when the pulse is removed from the coil windings for Relay R1 301, thereby not requiring constant energization and avoiding power loss.

To remotely turn OFF said apparatus 300, a second voltage pulse such as, for example, a 12 VDC pulse, a 24 VDC pulse, a 48 VDC pulse, etc., can be applied to the coil windings 301 for Relay R1. Energization of the coil windings 301 by the voltage pulse can open Relay R1's contact 303, thus de-energizing the load 304. The load 304 can be any type load, such as a light, a motor or any other device, or combination of devices, that is within the voltage and current specifications of the apparatus. Because Relay R1 is a mechanically latching relay, it can remain in this position when the pulse is removed from the coil windings 301 for Relay R1 thereby not requiring constant energization and avoiding power loss.

Because of the use of a mechanical latching relay, the coil associated with the relay R1 does not require constant energization. Thus, the device 300 does not consume energy while in the ON state or the OFF state.

To locally turn ON said apparatus 300, pressure can be applied in a first direction such as, for example, an upward direction, to a manual switch 306, mechanically coupled to Relay R1's contact 303 via the manual control 306, thereby causing Relay R1's contact 303 to close, thus energizing the load 304. The load 304 can be any type load, such as a light, a motor or any other device, or combination of devices, that is within the voltage and current specifications of the apparatus. Though not confined to this form, in one aspect the power control apparatus 300 can be embodied in the form of a standard, toggle, wall-mounted light switch.

To locally turn OFF said apparatus 300, pressure can be applied in a second direction such as, for example, a downward direction, to the manual switch 306, thereby causing Relay R1's contact 303 to open, thus de-energizing the load 304. The load 304 can be any type load, such as a light, a motor or any other device, or combination of devices, that is within the voltage and current specifications of the apparatus.

Also provided are methods for power control, comprising applying a low-voltage pulse such as, for example, a 12 VDC pulse, a 24 VDC pulse, a 48 VDC pulse, etc., to a coil associated with a relay contact, wherein the first, low-voltage pulse can be initiated remotely. If the relay is currently in an OPEN state, then the first pulse, applied to the coil, causes the relay contact to change from an OPEN state to a CLOSED state, thereby causing the relay to energize a load. If the relay is currently in a CLOSED state, then the pulse, applied to the coil, causes the relay contact to change from a CLOSED state to an OPEN state, thereby causing the relay to de-energize the load. The relay contact can also be controlled locally by a mechanically-operated switch. For example, applying a first pressure to a manual control, wherein the pressure causes the manual control to mechanically close or open the relay contact, thereby energizing or de-energizing a load. For example, if the relay is currently in a CLOSED state, then the pressure applied to the manual control causes the relay contact to change from a CLOSED state to an OPEN state, thereby causing the relay to de-energize the load. If the relay is currently in an OPEN state, then the pressure applied to the manual control causes the relay contact to change from an OPEN state to a CLOSED state, thereby causing the relay to energize the load.

Figure 4:
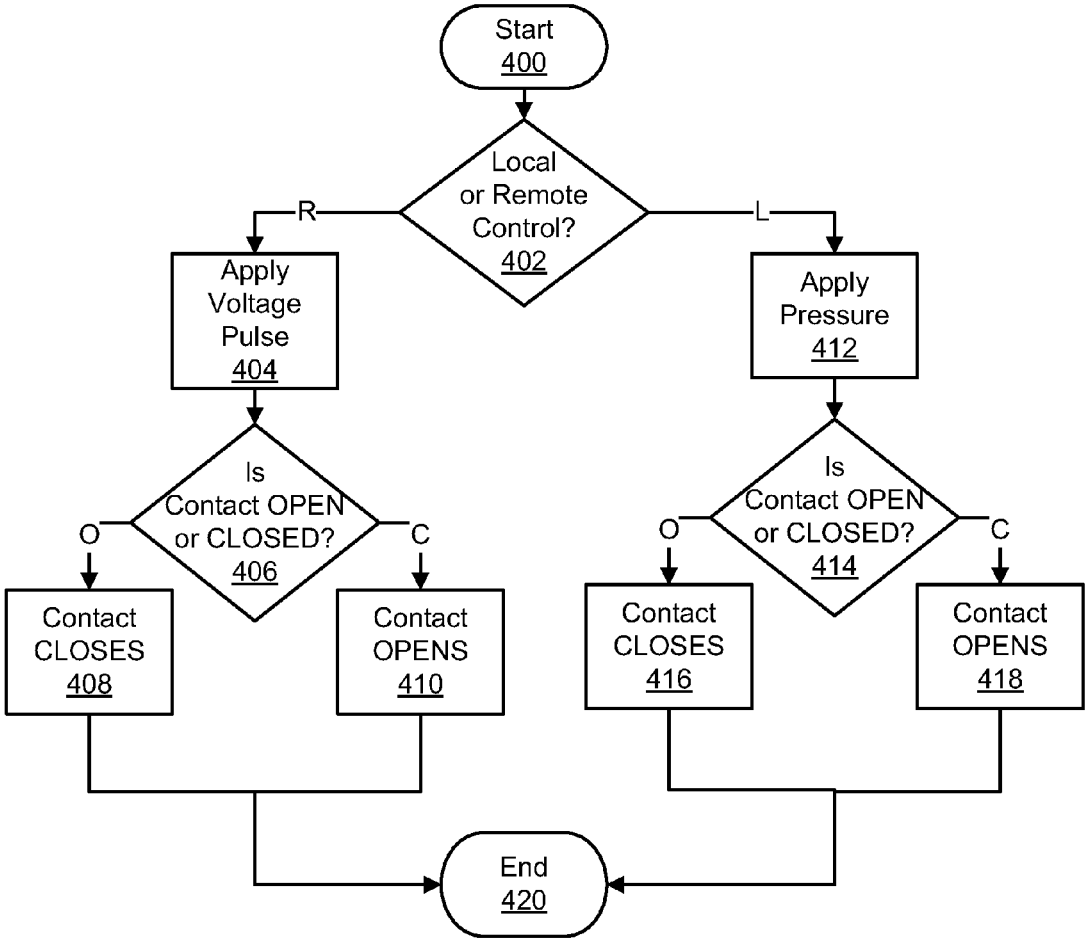
FIG. 4 is a flowchart illustrating a method of power control using a device such as the one shown in FIG. 3.

FIG. 4 provides a flowchart illustrating a method of power control using a device 300 such as the one shown in FIG. 3. The process starts at step 400. At step 402, it is determined whether the power control device 300 is to be controlled locally or remotely. If remotely, then the process goes to step 404, where a voltage pulse is applied to the coil windings 301. At step 406, it is determined whether the relay contact 303 is in an OPEN state or a CLOSED state. If in an OPEN state, then at step 408 the voltage pulse applied to the coil windings 301 causes the relay contact 303 to CLOSE. If, at step 406 it is determined that the relay contact is in a CLOSED state, then at step 410 the voltage pulse applied to the coil windings 301 causes the relay contact 303 to OPEN. Returning to step 402, if it is determined that the power control device 300 is to be controlled locally, at step 412 pressure is applied to a manual control associated with the power control device 300. At step 414, it is determined whether the relay contact 303 is in an OPEN state or a CLOSED state. If in an OPEN state, then at step 416 the pressure applied to the manual control causes the relay contact 303 to CLOSE. If, at step 414 it is determined that the relay contact is in a CLOSED state, then at step 418 the pressure applied to the manual control causes the relay contact 303 to OPEN. The process ends at step 420.

Figure 5A:
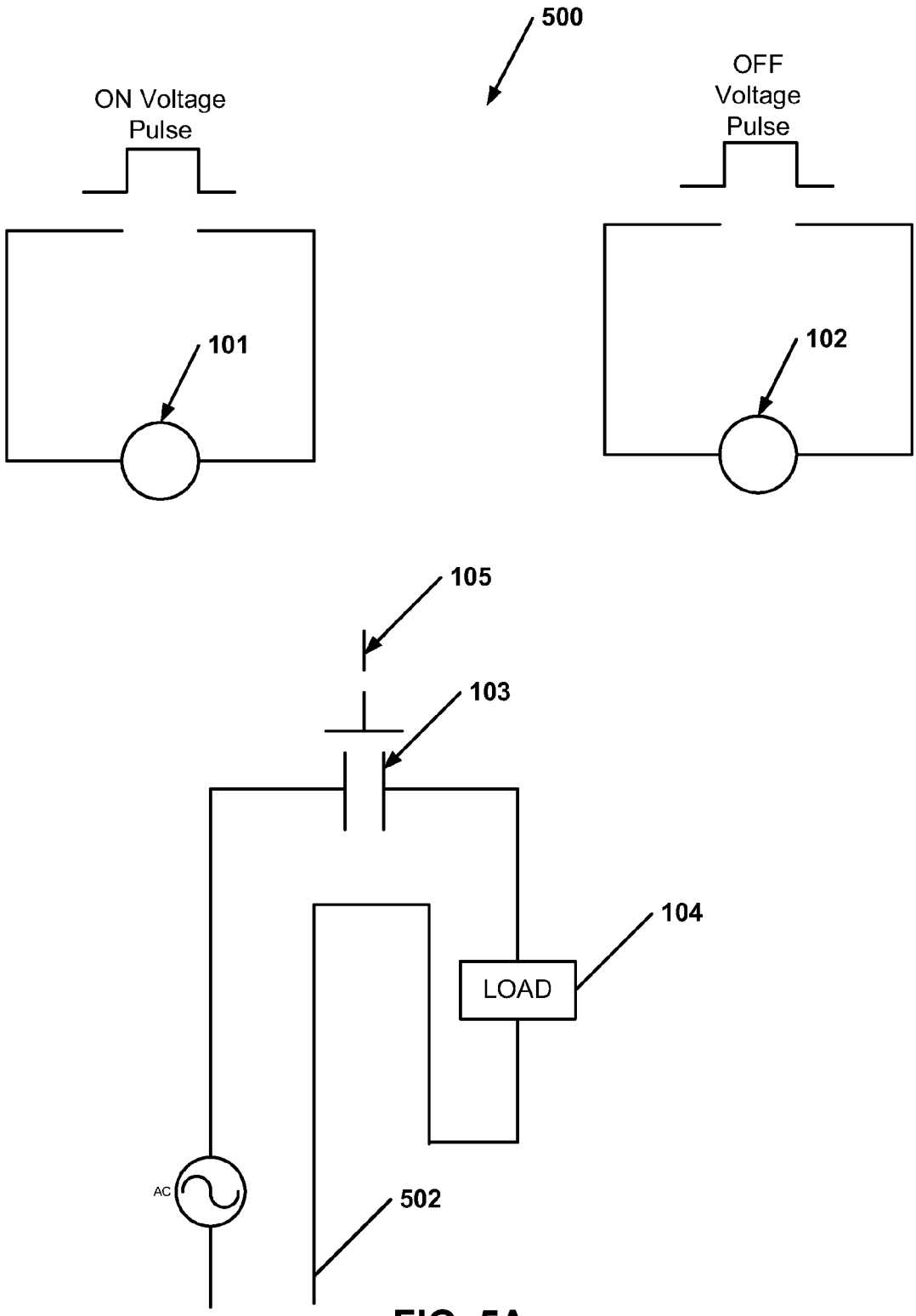
FIG. 5A is a three-wire embodiment of a power control apparatus having more than one coil for operation of the relay contact, similar to the apparatus shown in FIG. 1.

In one aspect, illustrated in FIG. 5A is a three-wire embodiment of a power control apparatus 500 having more than one coil for operation of the relay contact 503, similar to the apparatus shown in FIG. 1. This embodiment comprises the neutral wire 502. This embodiment operates in the manner described in relation to FIGS. 1 and 2, as described above.

Figure 5B:
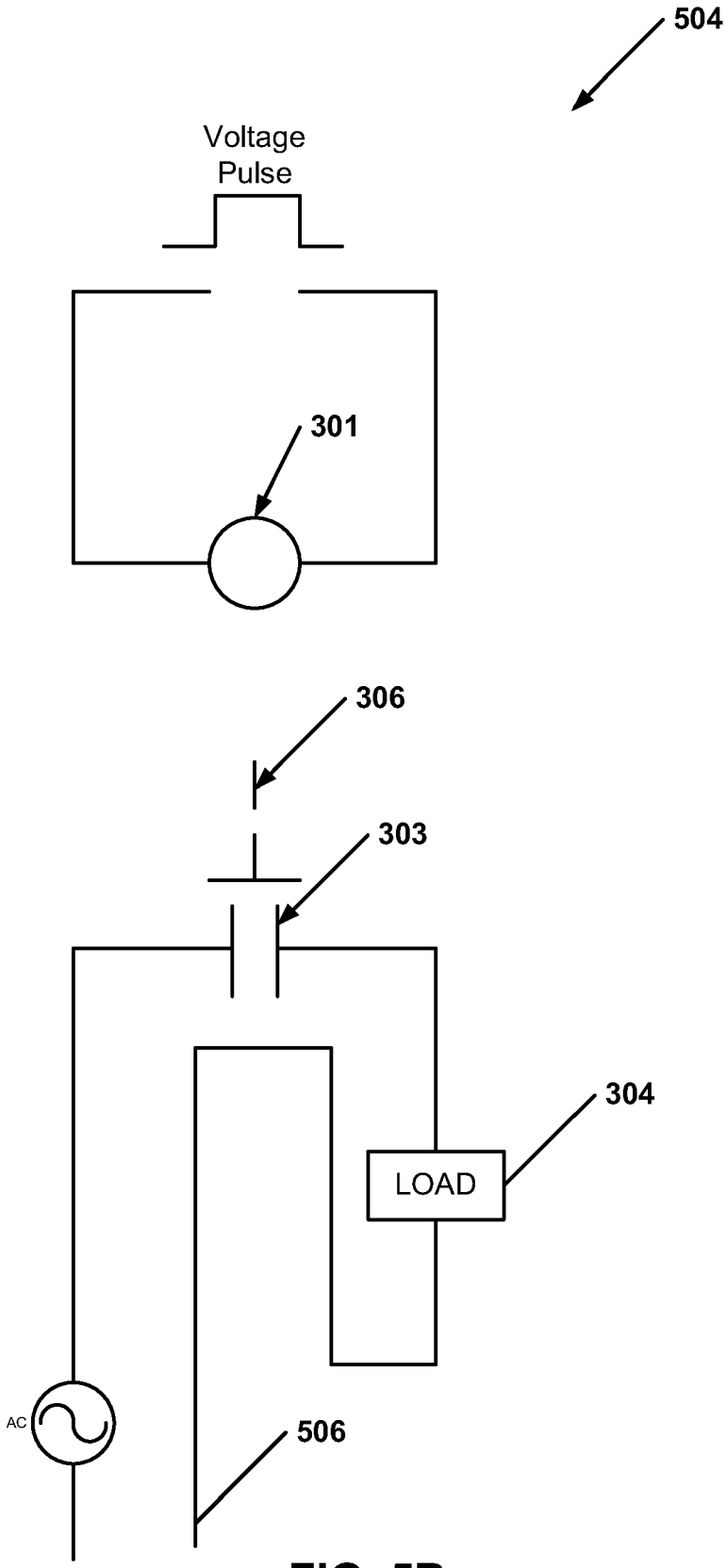
FIG. 5B is a three-wire embodiment of a power control apparatus having one coil, similar to the apparatus shown in FIG. 3.

In another aspect, illustrated in FIG. 5B is a three-wire embodiment of a power control apparatus 504 having one coil, similar to the apparatus shown in FIG. 3. This embodiment comprises the neutral wire 506. This embodiment operates in the manner described in relation to FIGS. 3 and 4, as described above.

Figure 6:
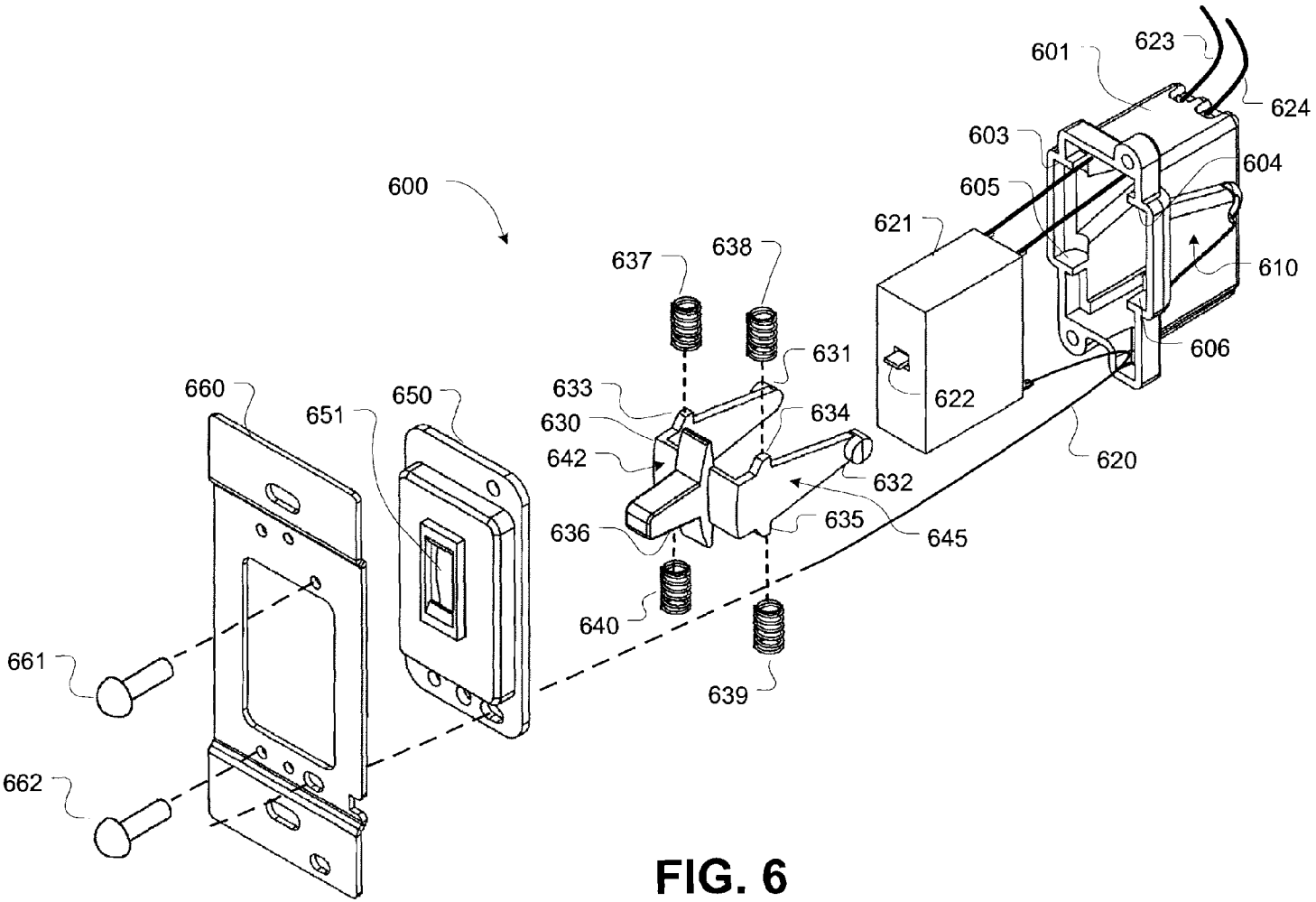
FIG. 6 is an exploded perspective view of a power control device and its assembly in accordance with another aspect of the invention.

Turn now to FIG. 6 for discussion and description of another aspect of the present invention relating to a switch assembly 600 that is operative to provide for remote power control as described above, with mechanical components that provide for local manual control by a person. Advantageously, the assembly 600 is provided in the form of a standard, toggle, wall-mounted, compact, and low cost light switch that operates in the familiar manner to allow a person to switch a load on or off, but yet also allows a remote power control via remote actuation of a relay contained within the assembly.

FIG. 6 shows an exploded view of the switch assembly 600 according to this aspect of the invention. The switch assembly 600 comprises a switch housing 601 that encloses and houses a relay 621 operative as described above for remote power control, and that is manually actuated (overridden) via a switch lever 630 by a person that wishes to place the relay into a different state for local manual control. The switch housing 601 is a molded plastic piece designed to hold in-place latching relay 621. Relay 621 is a latching relay manufactured by KG Technologies, Cotati, Calif. (USA), part number K110-4/24-ZOT-L2-0. The preferred latching relay includes a mechanical override switch actuator 622 that extends from the front surface of the body of the relay 621 and operates in the known manner to allow a manual movement actuation to change the state of the relay from on to off, or from off to on.

Figure 7:
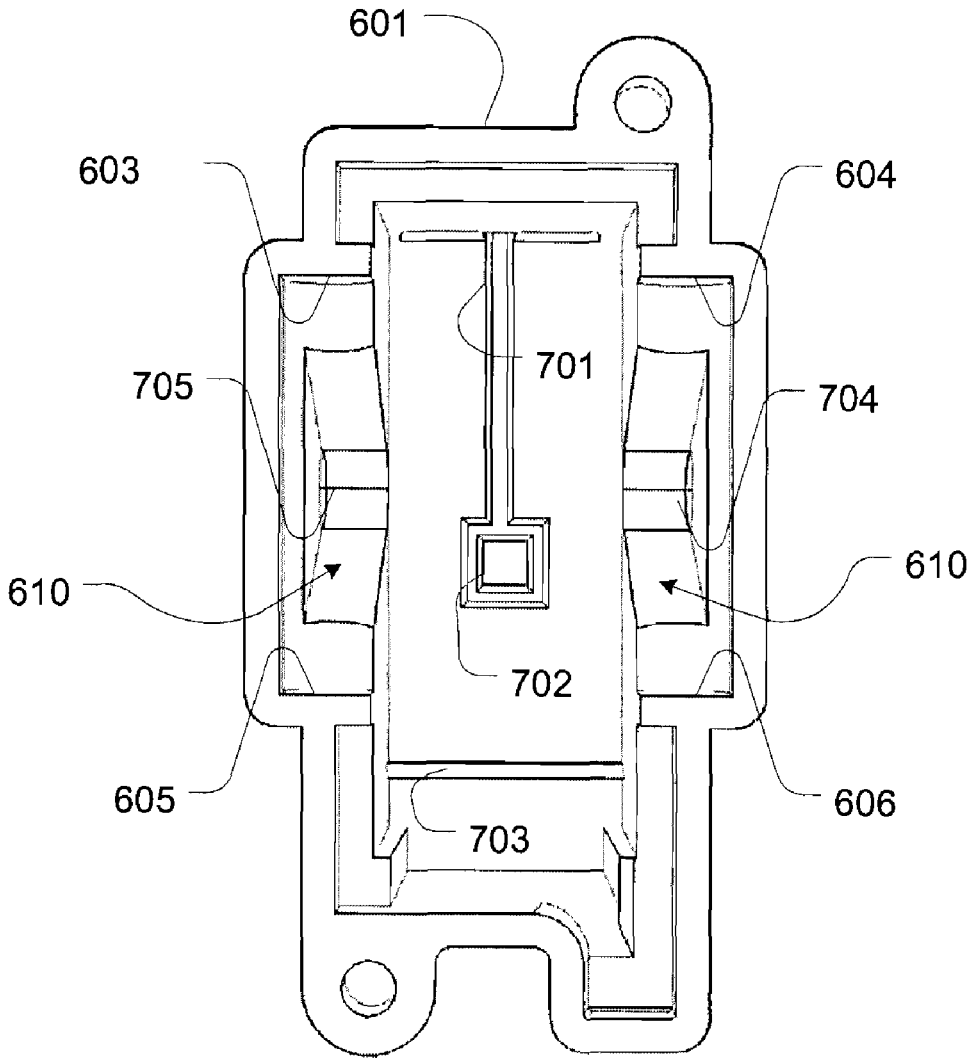
FIG. 7 is a front perspective view of switch housing of the assembly of FIG. 6.

FIG. 7 is a perspective front view of the switch housing 601 (prior to insertion of a relay 621) and illustrates the elements of the housing that receive and retain the switch lever 630 for manual actuation of the relay, and allow ready and easy assembly. The switch housing 601 includes a pair of generally triangularly shaped recesses 610 that receive and retain arms 645 of the switch lever 630. At the vertex of these triangular recesses are circular holes 704 and 705 designed to accept circular pivot points 631 and 632 formed at the ends of the arms 645. Once the switch lever 630 is inserted into switch housing 601, the circular pivot points 631 and 632 will snap into circular holes 704 and 705.

Latching relay 621 slides into switch housing 601 and is held in position by locking point 702 shown in FIG. 7. Also shown in FIG. 7 is barrier 701 which provides a barrier between both load conductors 623 and 624. Barrier 703 shown in FIG. 7 provides a stabilizing structure for latching relay 621 and a barrier to separate the load conductors 623 and 624 from the low voltage control conductors 620. Points 603, 604, 605 and 606 provide resting points for springs 637, 638, 639 and 640, respectively. Points 633, 634, 635 and 636 provide locking points to the switch lever 630 for springs 637, 638, 639 and 640 respectively. Spring 637 is locked in place and compressed between points 633 and 603. Spring 638 is locked in place and compressed between points 634 and 604. Spring 639 is locked in place and compressed between points 635 and 606. Spring 640 is locked in place and compressed between points 636 and 605. These springs provide an equal and apposing force to the spring on its opposite side thus maintaining the switch lever 630 in a centered position.

Figure 8:
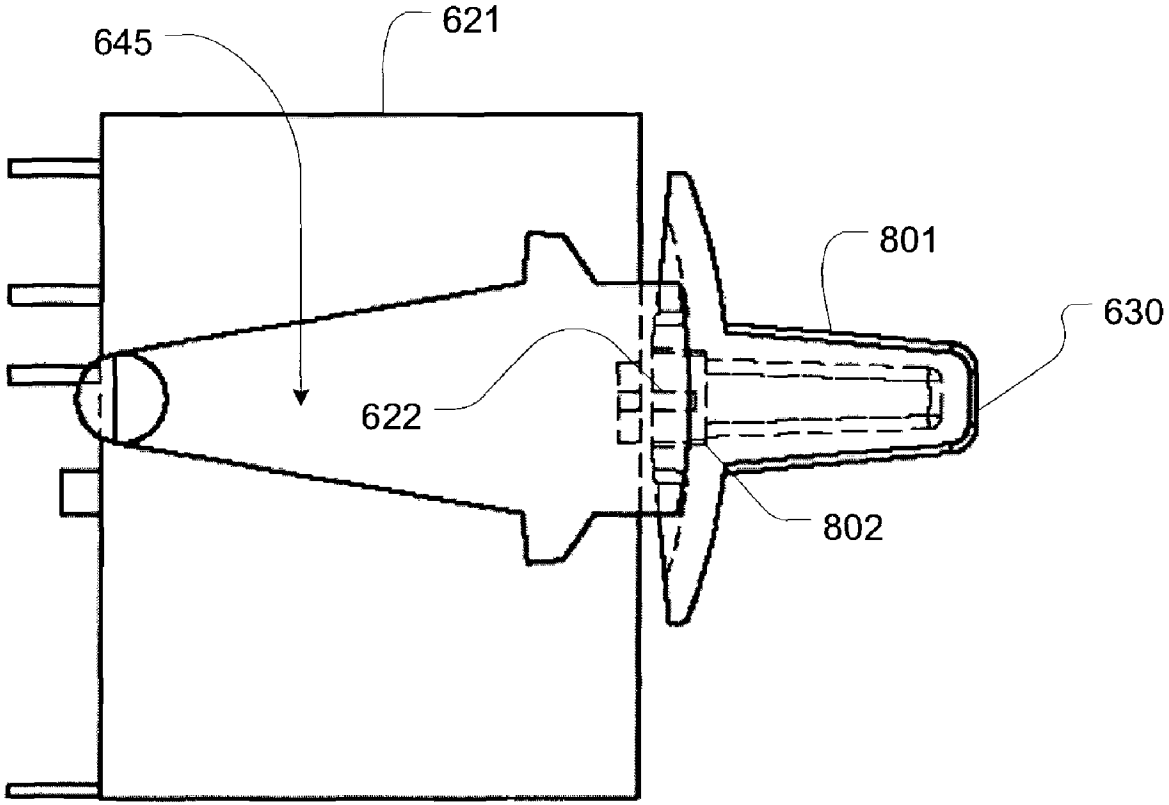
FIG. 8 is a side, partial view of a latching relay and a mating switch lever of the assembly of FIG. 6.

Referring now to FIG. 8 and FIG. 10, switch lever 630 is a molded plastic piece with a generally frustum-shaped actuator element 801 that extends through opening 651 in switch cover 650 (see FIG. 6), for actuation by a person. The switch lever 630 includes a pair of parallel, generally triangular planar portions or arms 645 extending from a bridge member 642 in a direction opposite the actuator element 801 toward a vertex and circular pivot points 631 and 632. An actuation chamber 802 is defined in the back surface of the bridge element 642 and, in one embodiment, into the actuator element 801 for engaging with a relay mechanical override switch 622 (FIG. 6) on the relay 621. The circular pivot points 631 and 632 provide the axis points that allows switch lever 630 to pivot on a rotational axis allowing a surface of the actuation chamber 802 to engage and apply pressure to the relay mechanical override switch 622 in either direction, thus opening or closing the contacts within the relay 621 and allowing or disallowing current flow through load conductors 623 and 624. Upon release by a person of the switch lever 630, springs 637, 638, 639 and 640 will return the switch lever 630 back to a centered position, allowing the relay mechanical override switch 622 to move freely upon actuation by a remote signal.

Referring now to FIG. 9, the switch cover 650 is a molded plastic piece which acts as a guide for the switch lever 630. Switch cover 650 also provides an anchoring point for switch plate 660. As shown in FIG. 6, rivets 661 and 662 pierce face plate 660, cover 651 and switch housing 601 to properly secure all items.

Figures 9A, 9B, 9C, 9D:
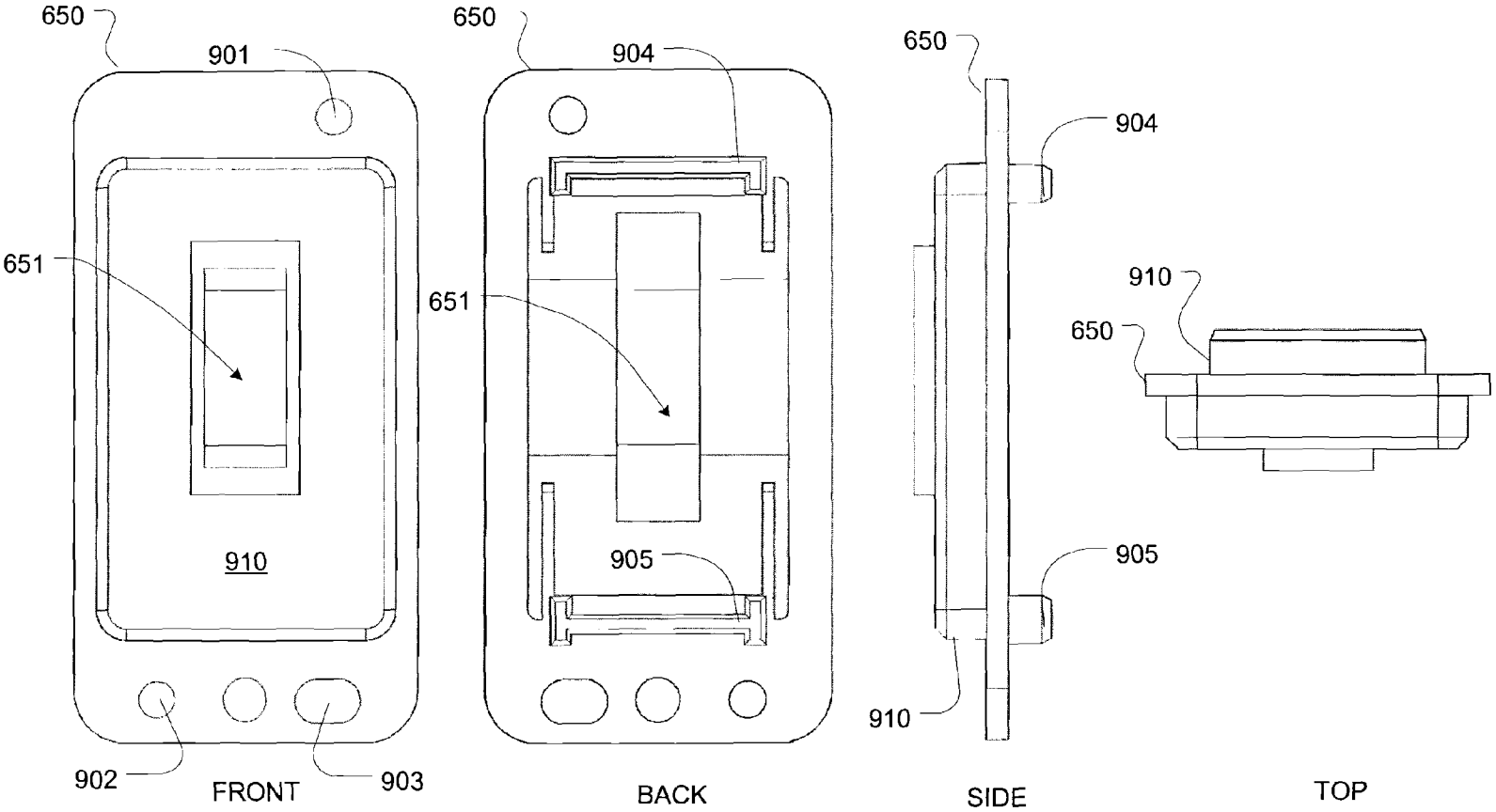
FIG. 9, consisting of FIGS. 9A through 9D, are plan views of the switch cover of the assembly of FIG. 6.

FIG. 9A shows a front plan view of the switch cover 650. This item is a molded plastic piece of rectangular shape with rounded outer corners. It has a rectangular center section 910 which protrudes outward from its front. This rectangular center 910 is designed to accept and lock in place switch plate 660. In the center of this section is a smaller rectangular opening 651 which provides the point through which the switch lever actuator 801 passes. Openings 901 and 902 provide the passage points for rivets 661 and 662 shown in FIG. 6. Opening 903 provides the passage point through which low voltage control wires 620 pass.

FIG. 9B shows a rear plan view of switch cover 650. Items 904 and 905 are sections of the switch cover that provide additional stabilization and support for relay 621. These items protrude out slightly from the back of the switch cover and are properly dimensioned to cradle the top section of relay 621.

Figures 10A, 10B, 10C, 10D:
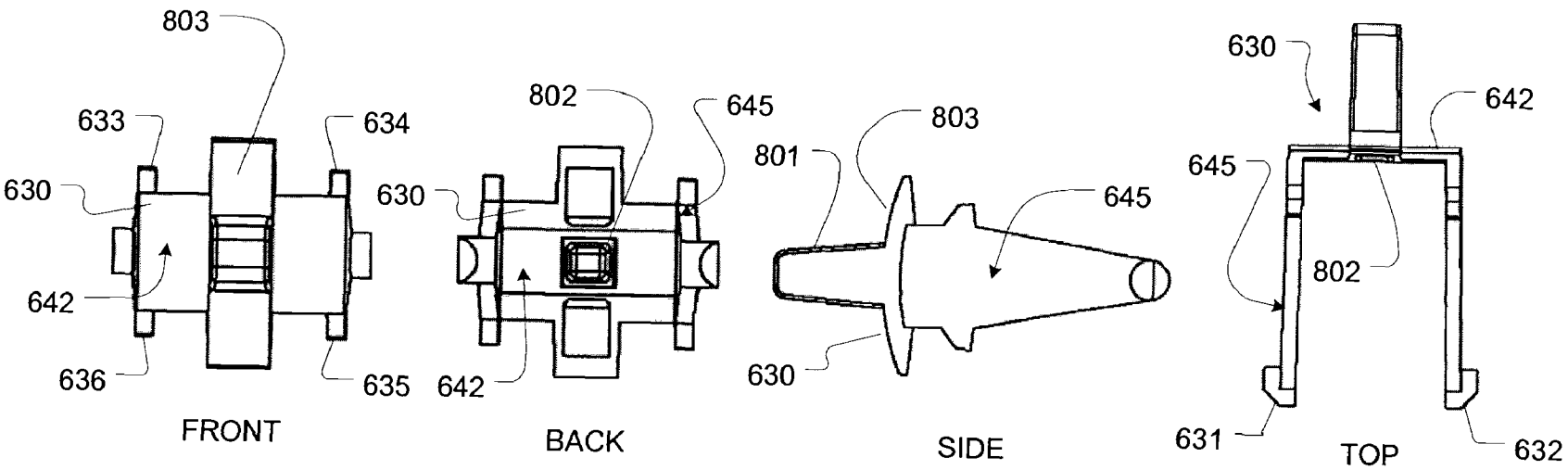
FIG. 10, consisting of FIGS. 10A through 10D, are plan views of the switch lever of the assembly of FIG. 6.
Figure 11D:
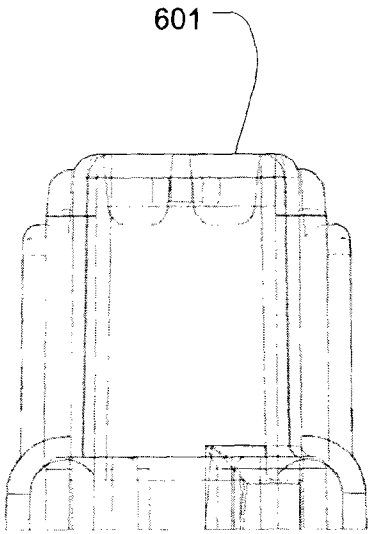
FIG. 11, consisting of FIGS. 11A through 11D, are plan views of the switch housing of the assembly of FIG. 6.
Figure 11C:
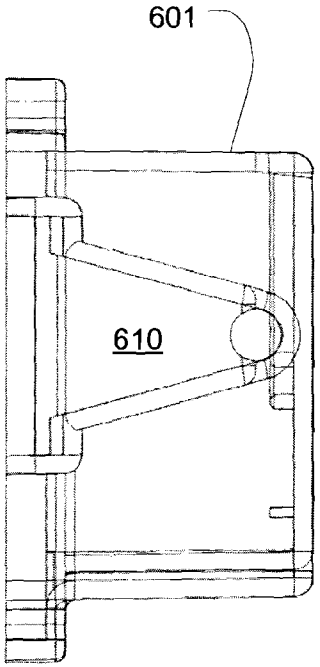
Figure 11B:
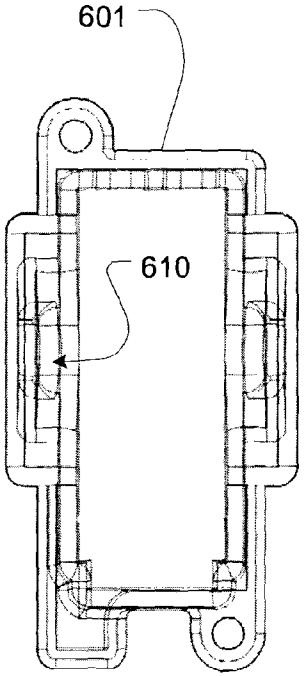
Figure 11A:
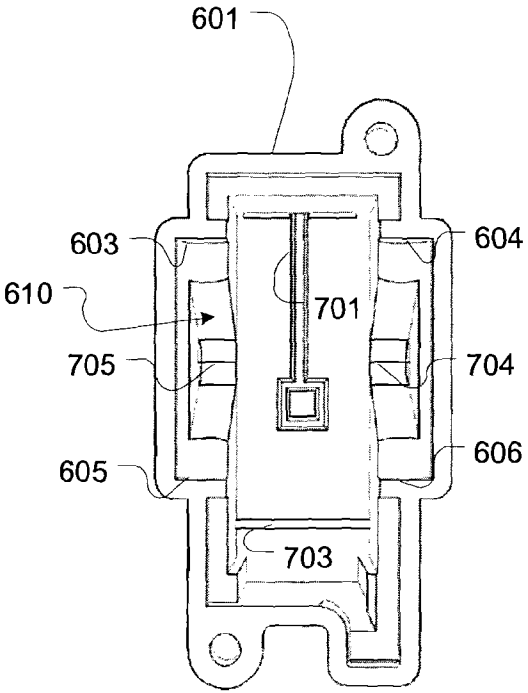

FIG. 10 provide plan views of the switch lever 630 according to an aspect of the invention. FIG. 10A shows a front plan view of switch lever 630. This switch lever is a molded plastic piece with an actuator element 801 that extends outward and provides a means for a person to manipulate the relay switch mechanical override and thus change the state of the switch from on to off or off to on. Attached to the back of the actuator element 801 is an arched section 803 which is designed to slidably engage with a corresponding curved back surface of the switch cover 650. Behind arched section 803 are the two parallel arms 645 which extend in an opposite direction from the actuator element 801 and are shaped in a generally triangular fashion while ending with a circular pivot point at its vertex. These arms 645 are designed to straddle the relay 621, provide an attachment point for springs 637, 638, 639 and 640, and provide a pivot point so that it can rotate in a limited arc, as confined within the recesses 610 of the switch housing 601.

Still referring to FIG. 10, directly behind arched section 803 and precisely in the middle between both arms 645 is the actuation chamber 802. This chamber 802 is preferably a square opening larger than the throw or actuation travel path of the relay mechanical override switch 622 such that the relay mechanical override switch 622 can move freely within it while the switch lever 630 is in the centered position. Once pressure is applied to the top or bottom of the actuator element 801 by a person, the switch lever 630 will move in the direction pressure is applied and either the top or bottom wall of actuation chamber 802 will come in contact with the relay mechanical override switch 622 and move the mechanical override of the relay, thus changing the state of the relay from either on to off or off to on.

At the vertex of arms 645 are the circular pivot points 631 and 632 shown in FIG. 10D which allow movement of switch lever 630. These circular pivot points each have a tapered end which facilitates the snap-in assembly of the switch lever 630 into the housing 601. Approximately ¼ the way down the arms 645 are two rudder sections 633, 634, 635 and 636 which are designed to lock in place springs 637, 638, 639, 640.

FIG. 11 further illustrates the switch housing 601. FIG. 11A shows a front view of switch housing 601. This switch housing is a molded plastic piece that is designed to hold in-place latching relay 621. This housing is in a generally rectangular shape. It has two receiving chambers or recesses 610 on opposite side walls that are generally triangular in shape and are designed to accept and confine movement of the arms 645 of the switch lever 630. At the vertex of these triangular sections are circular holes 704 and 705 designed to accept circular pivot points 631 and 632. Once the switch lever 630 is inserted into switch housing 601, the circular pivot points 631 and 632 will snap into circular holes 704 and 705. Also shown in FIG. 11A is barrier 701 which provides a barrier between both load conductors 623 and 624. Barrier 703 provides a stabilizing structure for latching relay 621 and a barrier to separate the load conductors 623 and 624 from the low voltage control conductors 620. Points 603, 604, 605 and 606 provide resting points for springs 637, 638, 639 and 640 respectively.

From the foregoing, it will be appreciated that there has been shown and described a novel assembly of components for a power control device, including a latching relay with manual override, that is mounted and retained within a switch housing of a size and shape conventional and customary for utilization in residential and commercial electrical power wiring for lighting and other purposes, with the switch housing supporting a switch lever that extends from the body of the switch housing and can be manually actuated by a person to override the state of the relay, wherein the relay can be remotely actuated by a signal to its switching terminal to switch a power load connected to the relay on or off, as appropriate, and wherein the relay can be manually overridden by actuation of the switch lever, with the overall assembly being low cost, easy to manufacture and assemble, and has the appearance of a conventional wall lighting switch.

While the methods, systems, and apparatuses have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method, set forth herein, be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A power control apparatus, comprising: a latching relay for controlling an electrical load and including a manual override switch actuator, the latching relay including power terminals and a switching terminal for remote actuation by a signal, the latching relay switching from a first state to a second state upon provision of the signal to the switching terminal or manual actuation by the manual override switch actuator; a switch housing of a size and shape customary for utilization in residential and commercial electrical power wiring, the switch housing supporting and retaining the latching relay; a switch lever extending from the body of the switch housing for manual actuation by a person to override the state of the relay, the switch lever engaging the manual override switch actuator of the latching relay upon manual actuation by a person, the switch lever comprising a pair of parallel arms extending into said switch housing, the parallel arms being resiliently deformable such that the arms partially deform towards each other during assembly by insertion into the switch housing but resiliently return to an initial undeformed state after insertion into the switch housing; the switch housing further comprising a pair of recesses that are shaped and sized to receive and retain the parallel arms such that the arms are movable within the recesses upon manual actuation of the switch lever but confined in movement by interior surfaces of the recesses; and a centering structure for maintaining the switch lever in a centered position to allow unimpeded movement of the manual override switch actuator.

2. The power control apparatus of claim 1, wherein the latching relay manual override switch actuator extends from a surface of the latching relay, and wherein the switch lever includes a chamber defined therein for engaging with the manual override switch actuator.

3. The power control apparatus of claim 1, wherein the switch housing includes openings for receiving electrical wires for connection to the latching relay that are coupled to the electrical load and signal electrical wires that are connected to the switching terminal.

4. The power control apparatus of claim 1, wherein the switch lever includes an actuator element, a bridge member, and wherein the pair of parallel arms extend from opposite outer edges of the bridge member in a direction opposite the actuator element, the actuator element for manual actuation by a person.

5. The power control apparatus of claim 4, wherein the pair of parallel arms are received and retained in said switch housing recesses so as to provide for partial rotatable movement of the switch lever.

6. The power control apparatus of claim 4, wherein the switch lever includes an actuation chamber defined in the bridge member opposite the actuator element for receiving and engaging the manual override switch actuator of the latching relay, the dimensions of the actuation chamber sized so that the manual override switch actuator is permitted free movement within the chamber when the latching relay is actuated, but is engaged by an inner surface of the actuation chamber to move the manual override switch actuator to change the state of the latching relay upon manual movement of the switch lever.

7. The power control apparatus of claim 1, further comprising a switch cover affixed to the switch housing for enclosing and retaining the latching relay and the switch lever, the switch cover including an opening defined in a surface through which an actuator element of the switch lever extends and is accessible for manual actuation.

8. The power control apparatus of claim 1, wherein the centering structure comprises at least one spring mounted between a portion of the switch lever and an interior surface of the switch housing, for maintaining the switch lever in a centered position.

9. The power control apparatus of claim 8, wherein the at least one spring comprises a plurality of coil springs mounted on opposite sides of the switch lever that return the switch lever to a centered position once pressure is released on the switch lever.

10. The power control apparatus of claim 1, wherein said power control apparatus is embodied in the form of a standard, toggle, wall-mounted light switch.

11. The power control apparatus of claim 1, wherein the parallel arms include protrusions on opposite sides of the arms for engaging with and retaining springs that return the switch lever to a centered position when in a resting state.

12. The power control apparatus of claim 1, wherein the parallel arms include generally circular pivot elements that are received and confined within corresponding generally circular cavities in the switch housing and allow partial rotation of the switch lever.

13. The power control apparatus of claim 12, wherein the pivot elements of the parallel arms include a tapered surface so as to facilitate slidable engagement of the arms into the recesses.

14. A power control apparatus, comprising: a latching relay switch including a manual override switch actuator extending from a surface of the relay switch, the relay switch operative to switch an electrical load connected to its power terminals on and off in response to (a) an electrical signal provided on a relay input terminal from a remote control source, and (b) manual actuation of the manual override switch actuator; a switch housing for retaining and supporting the relay switch, the switch housing including openings for receiving electrical wires for connection to the relay switch that are coupled to the electrical load and signal electrical wires that are connected to the relay input terminal, the switch housing further including a pair of recesses for receiving and retaining a switch lever for partial rotatable movement; a switch lever including an actuator element, a bridge member, and a pair of parallel arms extending from opposite outer edges of the bridge member in a direction opposite the actuator element, the actuator element for manual actuation by a person, the pair of parallel arms being received and retained in the pair of switch housing recesses for partial rotatable movement; and the switch lever including an actuation chamber defined in the bridge member opposite the actuator element for receiving and engaging the manual override switch actuator of the latching relay switch, the dimensions of the actuation chamber being larger than a throw travel path of the manual override switch actuator so that the manual override switch actuator moves freely within the actuation chamber while the switch lever is in a centered position when the latching relay switch is actuated by the remote control source, but is engaged by an inner surface of the actuation chamber to move the manual override switch actuator to change the state of the latching relay switch upon manual movement of the switch lever.

15. The power control apparatus of claim 14, further comprising a plurality of coil springs mounted between the arms of the switch lever and an interior surface of the recesses of the switch housing, for maintaining the actuator element in a centered position.

16. The power control apparatus of claim 15, wherein the coil springs return the switch lever to a centered position once pressure is released.

17. The power control apparatus of claim 14, wherein said power control apparatus is embodied in the form of a standard, toggle, wall-mounted light switch.

18. The power control apparatus of claim 14, wherein the parallel arms are generally triangular in shape, and wherein the pair of recesses in the switch housing are also generally triangularly shaped but with a larger angle than that of the parallel arms, such that the arms are movable within the recesses upon manual actuation of the switch lever but confined in movement by interior surfaces of the recesses.

19. The power control apparatus of claim 18, wherein the parallel arms include protrusions on opposite sides of the arms for engaging with and retaining springs that return the switch lever to a centered position when in a resting state.

20. The power control apparatus of claim 14, wherein the parallel arms include generally circular pivot elements that are received and confined within corresponding generally circular cavities in the switch housing and allow partial rotation of the switch lever.

21. The power control apparatus of claim 20, wherein the pivot elements of the parallel arms include a tapered surface so as to facilitate slidable engagement of the arms into the recesses.

22. The power control apparatus of claim 20, wherein the parallel arms are resiliently deformable such that the arms are partially deformed towards each other during assembly by insertion of the arms into the recesses in the switch housing but resiliently return to an initial undeformed state when the pivot elements engage with their respective cavities in the switch housing.

23. The power control apparatus of claim 14, further comprising a switch cover affixed to the switch housing for enclosing and retaining the latching relay switch and the switch lever, the switch cover including an opening defined in a surface through which the actuator element of the switch lever extends and is accessible for manual actuation, wherein the switch cover includes a generally rectangular section extending from a surface opposite the switch housing, and further comprising a face plate configured with mounting holes for mounting into a conventional electrical switch box, the face plate including a generally rectangular opening for receiving and retaining the generally rectangular section of the switch cover.

24. The power control apparatus of claim 23, wherein the switch cover includes elements for engaging and retaining the relay switch when the switch cover is affixed to the switch housing.

25. The power control apparatus of claim 14, wherein the switch housing includes barrier elements defined on the interior of the switch housing for isolation and separation of wires connected to the power terminals of the relay switch and wires connected to the relay input terminal.

* * * * *